US007032939B2

(12) United States Patent
Magnusson

(10) Patent No.: US 7,032,939 B2
(45) Date of Patent: Apr. 25, 2006

(54) LOCK

(75) Inventor: Claes Magnusson, London (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 10/431,542

(22) Filed: May 8, 2003

(65) Prior Publication Data

US 2004/0222643 A1 Nov. 11, 2004

(51) Int. Cl.
*E05B 63/20* (2006.01)

(52) U.S. Cl. ..... 292/333; 292/121

(58) Field of Classification Search ..... 292/121, 292/124, 332, 333, 336
See application file for complete search history.

(56) References Cited

U.S. PATENT DOCUMENTS 2,698,197 A * 12/1954 Jacobson ..... 292/336
3,065,986 A * 11/1962 Barker et al. ..... 292/332
3,572,066 A * 3/1971 Peters ..... 70/156
3,776,582 A * 12/1973 Balducci ..... 292/92
4,351,288 A * 9/1982 Gasloli ..... 126/197
5,566,991 A * 10/1996 Young ..... 292/201

FOREIGN PATENT DOCUMENTS

| | | |
|---|---|---|
| JP | 10-238188 | 9/1998 |
| JP | 10-280769 | 10/1998 |
| JP | 10-280770 | 10/1998 |
| WO | WO 95/09958 | 4/1995 |

* cited by examiner

*Primary Examiner*—Gary Estremsky
(74) *Attorney, Agent, or Firm*—Paul & Paul

(57) ABSTRACT

A lock has a lock casing and a spring-loaded trigger guided for reciprocating movement within the housing. A hook-like bolt is arranged within the housing to be movable between an unengaged position and an engagement position. In a first position, as support surface of the spring-loaded trigger retains the bolt in its unengaged position. In a second position the spring-loaded trigger releases the bolt for movement towards its engagement position.

4 Claims, 3 Drawing Sheets

LOCK

FIELD OF THE INVENTION

The present invention concerns a lock, and more particularly a lock having a lock casing, and a spring-loaded trigger guided for reciprocating movement within the housing.

BACKGROUND OF THE INVENTION

When shutting a sliding door or a hinged door having a plane door leaf, it is normally no problem to precisely and repeatedly achieve engagement between a trigger of a lock carried by the door and an associated striking plate of a door post or the like, since the trigger movement is directed in the direction of the plane of the door leaf. When it comes to curved doors, however, which are rather frequent in yacht building, it is a problem that linear movement of an ordinary trigger does not provide accurate locking properties. There is a need, thus, for a lock having a locking member allowing proper locking of a door having a curved door leaf, and also allowing approach of the lock towards an associated striking plate or the like from a plurality of directions.

An object of the present invention, thus, is to provide a lock allowing engagement between its locking member and an associated striking plate or the like from various directions.

SUMMARY OF THE INVENTION

According to the present invention there is provided a lock having a lock casing, and a spring-loaded trigger guided for reciprocating movement within the housing, wherein a hook-like bolt is arranged within the housing to be movable between an unengaged position and an engagement position, said spring-loaded trigger in a first position retaining the bolt in its unengaged position and in a second position releasing the bolt for movement towards its engagement position.

For cooperation with the hook-like bolt, it is preferred to provide the striking plate with a U- or 0-like engagement member. This is particularly advantageous since it allows approach of the lock towards the striking plate not only from one direction, but from a variety of directions.

BRIEF DESCRIPTION OF THE DRAWINGS

Further scope of applicability of the present invention will become apparent from the detailed description given hereafter. However, it should be understood that the detailed description and specific examples, while indicating preferred embodiments of the invention, are given by way of illustration only, since various changes and modifications within the spirit and scope of the invention will become apparent to those skilled in the art from this detailed description, wherein.

Figure 1:
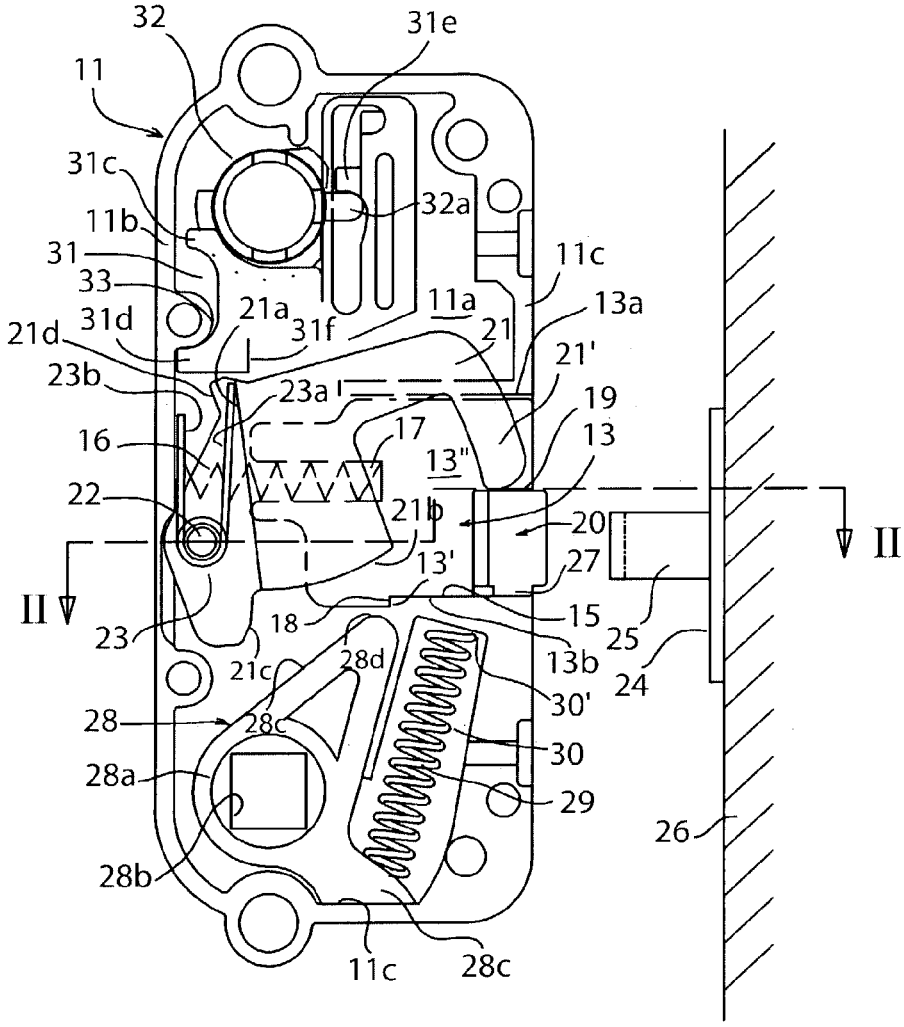
FIG. 1 is a view looking into the lock with one part of its casing removed and showing the bolt in its retained, open position and an engagement member of a striking plate at a distance from the lock.

The lock according to the present invention includes a housing 10 comprising two mating housing halves or parts 11 and 12. These are preferably cast or moulded and include opposed side walls 11*a*, 12*a*. The housing parts are joinable along encircling wall portions, including rear wall portions 11*b*, 12*b*, and front wall portions 11*c*, 12*c*.

A trigger 13 having parallel guide surfaces 13*a*, 13*b* is slidably guided between opposed, parallel guide surfaces 14, 15 formed in the material of the housing part 11. A spring 16 is supported at one against the rear wall portion 11*b*, while its other end rests in a recess 17 in the trigger 13 so as to urge the latter towards the front wall portion 11*c* (to the right in the Figures). A step 13' in the guide surface 13*b* restricts such movement of the trigger by abutment against a corresponding step 18 terminating the guide surface 15.

Figure 2:
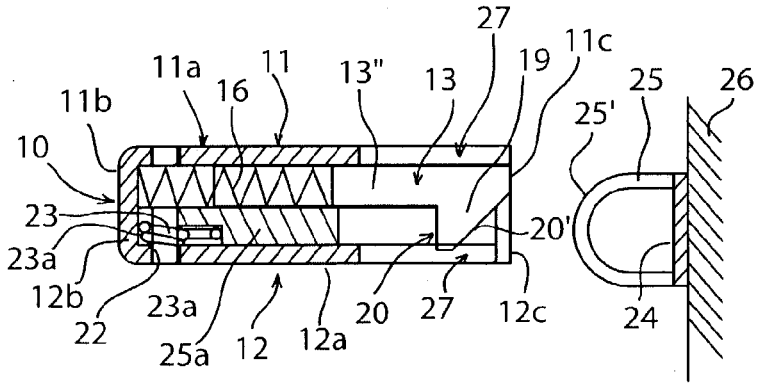
FIG. 2 is a cross section taken along line II—II in FIG. 1.

The trigger 13 has a generally flat main portion 13" occupying a space within the housing substantially defined by the housing part 11 (FIGS. 2 and 4). The trigger further exhibits an upwardly turned support surface 19 provided on an enlarged head portion 20 thereof extending into the housing part 12.

A hook-like bolt 21 is journalled at one end about a pivot pin 22 received in the opposed side walls 11*a*, 12*a* so as to occupy a space substantially within the housing part 12 (FIGS. 2 and 4). A coil spring 23 has its coil around the pin 22, a first leg 23*a* thereof bearing on a surface 21*a* of the bolt 21, and a second leg 23*b* thereof bearing on the rear wall 11*b* so as to urge the bolt in a clockwise direction according to FIGS. 1 and 3, i.e., from its positions shown in FIG. 1 to its position shown in FIG. 3.

The end of the bolt opposite to its pivoted end is provided with a downwardly turned hook-end 21'. In the position of the trigger 21 shown in FIGS. 1 and 2, i.e., its foremost position defined by abutment between the steps 13' and 15, the hook end 21' rests against the support surface 19 of the trigger head, the spring 23 striving to further rotate the bolt clockwise.

In FIGS. 1 and 2 is also shown a striking plate 24 having an engagement member 25. The striking plate is shown to be mounted on a door post 26 or the like. The engagement member has a generally annular or U-shaped sleeve-like configuration enabling engagement therein of the hook-end 21' of the bolt 21. Upon relative approach of the lock and the striking plate, a peripheral portion 25' of the latter encounters the head portion 20 of the trigger, thereby forcing the trigger against the force of the spring 16 towards the rear wall portion 11*b*.

Figure 3:
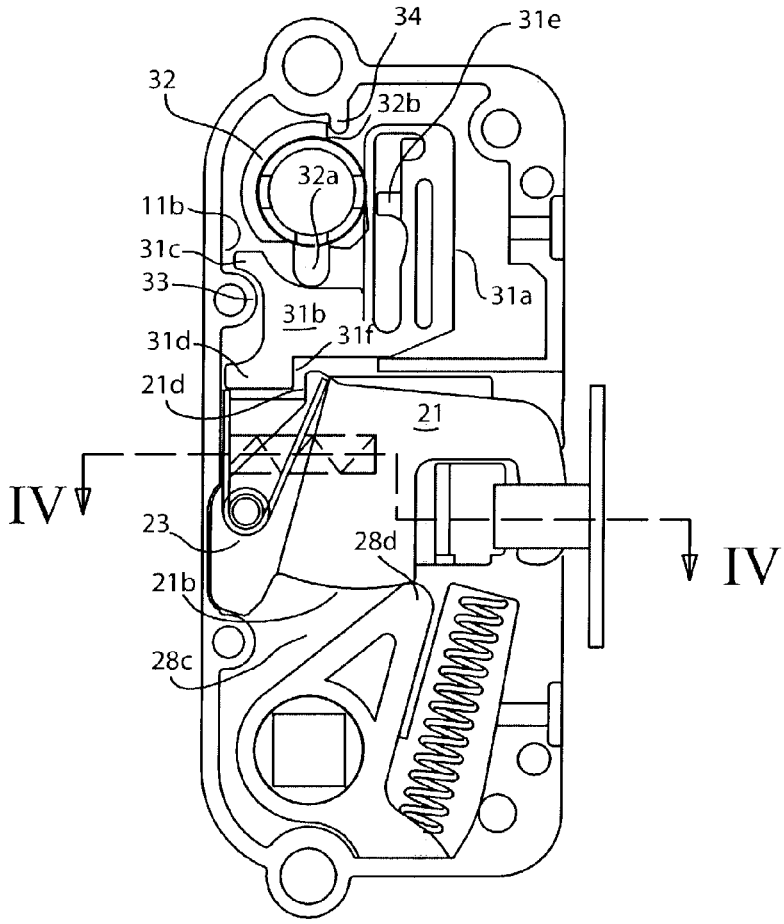
FIG. 3 is a view corresponding to that according to FIG. 1 but showing the bolt in its released, locking position engaging the engagement member.

After a certain displacement of the trigger, the hook-end 21' looses is support by the support surface 19, and the bolt is free to rotate under the load of the spring 23 towards its position shown in FIGS. 3 and 4. In this position of displacement, the engagement member 25 is positioned so that the released bolt forces its hook-end 21' into the sleeve-like engagement member to be retained therein by the force of the spring 23. Consequently, in this position, the lock and any door, hatch or the like to which it is attached, is locked to the striking plate 24 and thereby to the door post 26.

To enable approach of the engagement member from a variety of directions, the front wall portions 11*c*, 12, as well as adjacent portions of the opposed walls 11*a*, 12*a* have cut-out portions providing access to the trigger head as indicated at 27.

It is evident that the lock according to the present invention does not require the almost perfect alignment with an associated striking plate that is necessary for most ordinary locks for their proper locking engagement. With the embodiment of the present lock shown, engagement is possible over an angular range of about 180°, as long as an engagement member is in a position to depress the trigger in order to release the bolt.

In order to improve contact between the engagement member 25 and the trigger head 20 in order to achieve a proper depression of the trigger 13, it may be advantageous to chamfer its head 20 as shown at 20' in FIGS. 2 and 4.

A follower 28 is journalled in the opposed side walls 11*a*, 12*a* by means of opposed cylindrical bosses 28*a* (only one being seen in FIGS. 1 and 3) so as to be rotatable a limited angle by non shown handle spindle engaged in a square aperture 28*b* as seen in FIG. 3. A helical spring 29 has one end supported against an end 30' of a spring seat 30. The opposite end of the spring bears against one side of a nose portion 28*c* of the follower to urge the follower to rotate in a clockwise direction. An opposite side of the nose portion 28*c* limits such rotation by abutment against a wall portion 11*c* of the housing part 11, as seen in FIGS. 1 and 3, and simultaneously against a corresponding wall portion of the housing part 12.

Figure 5:
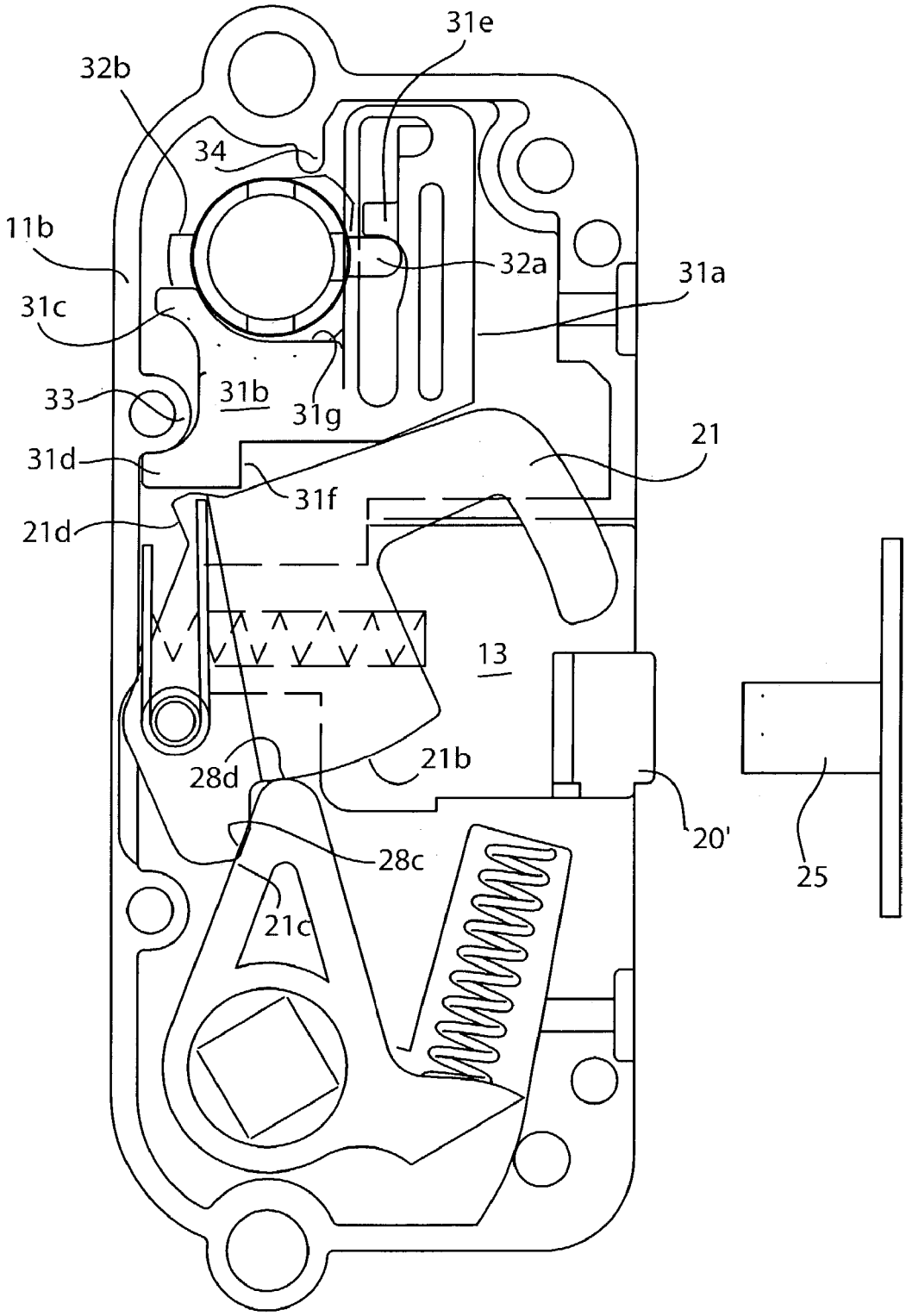
FIG. 5 is a view resembling that of FIG. 1, but showing the lock in a position being opened by the follower.

In the position of the follower shown in FIGS. 1 and 3, it limits movement of the bolt 21 in its released engagement position shown in FIG. 3 by engagement by a cam portion 28*d* of the follower with a cam surface 21*b* of the bolt. This is shown in FIG. 3. Rotation of the follower in a counter-clockwise direction by means of the non-shown handle spindle will cause sliding of the cam portion 28*d* along a portion of the cam surface 21*b* of the bolt, thereby forcing the latter to rotate counter-clockwise about its pivot pin 22 against the action of spring 23. When reaching a position similar to that shown in FIG. 1, in which the hook-end 21' has not only left the sleeve-shaped engagement member 25, thereby allowing opening of the door, but has also been raised to the level of the support surface 19 of the trigger head, the trigger 13 is free to move under the force of the spring 16 to regain its position of FIG. 1, thereby blocking movement of the bolt 21 and preparing the lock for a subsequent locking procedure. FIG. 5 shows an end position of the follower 28 and the bolt 21, where the bolt has been raised well above the release position for the trigger and further movement of these two inter-acting parts is restricted by mutual abutment 15 between an edge 28*c* of the follower and a depending finger 21*c* of the bolt.

In order to optionally prevent opening of the lock, it includes a blocking device comprising a blocking member 31 and a rotatable follower 31 operating the blocking member. The follower 32 is rotatably guided in opposed, non-shown apertures in the housing parts 11 and 12, and is manually operable by means of a likewise non-shown knob.

The follower has a radially protruding finger 32*a* for transmitting movement to the blocking member.

The blocking member is slidably guided between the opposed side walls 11*a*, 12*a* and against the front wall portions 11*b*, 12*b* of the housing parts so as to be movable a limited distance parallel to the front wall portions. The blocking member 31 is generally L-shaped having a vertical leg 31*a* and a horizontal leg 31*b*. The horizontal leg terminates in a fork-like portion having two spaced protrusions 31*c* and 31*d* straddling a boss 33 inwardly protruding from the front wall portions. Abutment between the protrusion 31*c* and the boss 33 limits downward movement of the blocking member, whereas abutment between the protrusion 31*d* and the boss 33 limits upward movement thereof.

As best seen in FIG. 3, the vertical leg 31*a* has a lug 31*e* protruding towards the follower 32 and positioned so as to be engaged by its finger 32*a* upon rotation of the follower in a counter-clock direction according to FIGS. 1, 3 and 5.

The blocking member 31 and the follower 32 are shown in FIG. 1 in a position where the blocking member is in its uppermost position with the protrusion 31*d* abutting the boss 33. In this position, a blocking edge 31*f* of the blocking member is out of the path of movement of a catch edge 21*d* of the bolt 21 so as to enable raising of the bolt to the open positions according to FIGS. 1 and 5.

With the bolt in its locking position according to FIG. 3, the follower 32 may be rotated clockwise to the position shown in FIG. 3, thereby forcing the blocking member downwards by sliding engagement between the finger 32*a* and a cam surface 31*g* of the blocking member such that the blocking edge 31*f* thereof is located in the path of movement of the catch edge 21*d* of the bolt, thereby positively preventing opening movement of the bolt. In this blocking position, as seen in FIG. 3, the finger 32*a* is directed perpendicularly to a horizontal portion of the cam surface 31*g*, thereby effectively arresting the blocking member in its blocking position. Further rotation of the follower 32 is prevented by abutment between a peripheral radial surface 32*b* thereof and an internal boss 34 of the housing.

Figure 4A:
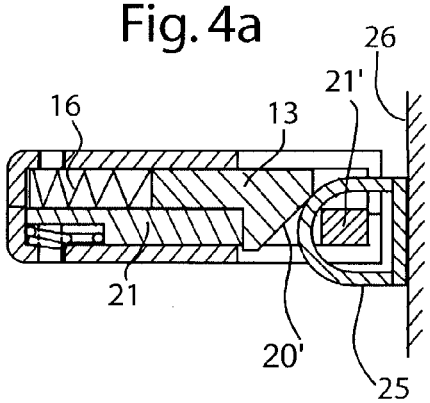
FIG. 4*a* is a cross section taken along line IV—IV in FIG. 3.
Figure 4B:
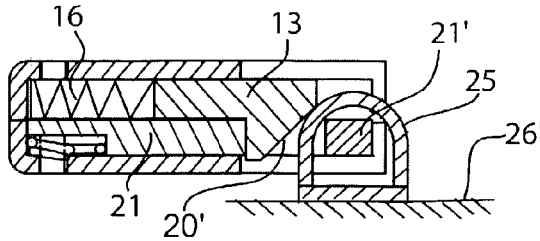
FIG. 4*b* is a cross section corresponding to FIG. 4*a*, but showing the engagement member in a different relative position.

As is evident from FIGS. 4*a* and 4*b*, a lock according to the present invention allows a wide range (substantially 180°) of mutual angular displacement between the lock and its associated engagement member 25 as exemplified by the lock being shown in one substantially central position relative the door post 26 and its engagement member 25 in FIG. 4*a* and in one substantially extreme angular position relative to the door post 26' and the engagement member 25 in FIG. 4*b*. It is obvious that the lock and the engagement member could be relatively rotated through 180° from the position of FIG. 4*b* and still provide for proper interlocking between the bolt 21 and the engagement member 25.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A lock having a lock casing and a spring-loaded trigger the housing and trigger being provided with structure and arranged whereby the trigger can reciprocatingly slide linearly between first and second positions, both within the housing where it is engaged and not engaged with the bolt, a hook-like bolt and housing being provided with structure and arranged whereby the bolt can rotate between an unengaged position and an engagement position, the bolt not extending beyond a maximum dimension of the housing outline in either position, said spring-loaded trigger in a first position retaining the bolt in its unengaged position and in a second position releasing the bolt for movement towards its engagement position, the bolt being spring-loaded towards its engagement position.

2. The lock according to claim 1, wherein a follower is arranged to move the bolt from its engaging position towards its unengaged position.

3. The lock according to claim 1, wherein the trigger is provided with a support surface, said support surface in said first position of the trigger supporting the bolt in its unengaged position.

4. The lock according to claim 3, wherein movement of the trigger from its first position towards its second position moves said support surface so as not to support the bolt.

* * * * *